US005974883A

United States Patent [19]

Ross

[11] Patent Number: 5,974,883

[45] Date of Patent: Nov. 2, 1999

[54] SYSTEM FOR AUTHENTICATING PRINTED DOCUMENTS

[75] Inventor: Gary A. Ross, Fife, United Kingdom

[73] Assignee: NCR Corporation, Dayton, Ohio

[21] Appl. No.: 09/022,805

[22] Filed: Feb. 13, 1998

[30] Foreign Application Priority Data

May 24, 1997 [GB] United Kingdom ..... 9710719

[51] Int. Cl.[6] ..... G01B 17/08

[52] U.S. Cl. ..... 73/587; 73/159; 73/432.1; 209/534; 209/590; 194/206

[58] Field of Search ..... 73/159, 579, 587, 73/865.9, 432.1; 209/534, 577, 588, 590; 382/135; 235/379, 449; 194/206, 207; 902/11, 12; 271/10.03, 121, 258.01, 265.01; 250/556; 377/8

[56] References Cited

U.S. PATENT DOCUMENTS

| | | | |
|---|---|---|---|
| 3,583,237 | 6/1971 | Bayha | 73/159 |
| 3,683,681 | 8/1972 | Taylor | 73/159 |
| 4,463,607 | 8/1984 | Hilton | 73/159 |
| 4,869,101 | 9/1989 | Dvorsky | 73/159 |
| 4,938,071 | 7/1990 | Kobayashi et al. | 73/159 |
| 5,014,547 | 5/1991 | Holroyd | 73/159 |

FOREIGN PATENT DOCUMENTS

| | | | |
|---|---|---|---|
| 0073133 | 3/1983 | European Pat. Off. . | |
| 168084 | 7/1986 | Japan | 73/587 |
| 168085 | 7/1986 | Japan | 73/587 |
| 169983 | 7/1986 | Japan | 73/587 |

*Primary Examiner*—Michael Brock
*Assistant Examiner*—Rose M. Miller
*Attorney, Agent, or Firm*—Gregory A. Welte

[57] ABSTRACT

A system for authenticating bank notes by checking for raised print (37) produced by an intaglio printing process which only occurs on genuine bank notes. Each note (36) is individually transported past a pair of brushes (38) whose bristles are in contact with the two faces of the note. Microphones (28) are placed in close proximity to the brush means to sense the noise from the brush means which increases when there is raised print. Output from the microphones are digitized and applied to a data processing means (22) which determines whether the note contains raised printing, and hence whether the note is genuine or not, by generating a value based on the digitized outputs of the microphones (28) and comparing this value with stored values.

23 Claims, 6 Drawing Sheets

SYSTEM FOR AUTHENTICATING PRINTED DOCUMENTS

BACKGROUND OF THE INVENTION

The present invention relates to a system for authenticating printed documents such as bank notes.

Bank notes have many features that make it difficult to forge them. However, forgers can now recreate many of these features such as threads and watermarks. The non-fluorescent properties of bank notes have been exploited for some time by retail establishments using ultra-violet lamps, but forgers can overcome this by suppressing the fluorescence of paper used for making forged bank notes. Thus, it is now difficult for sales staff to distinguish between real and forged notes. Validation is also a problem in self service terminals such as currency deposit machines where there is no human interaction to check for forgeries. Self service terminals include automated teller machines (ATMs) which allow bank customers to withdraw bank notes, and automated currency deposit machines by which bank customers can deposit bank notes.

SUMMARY OF THE INVENTION

It is an object of the present invention to provide a new system for authenticating printed documents.

According to the present invention there is provided a system for authenticating printed documents, characterized by transport means for transporting documents individually past brush means arranged to make contact with at least one face of each document, at least one acoustic sensor arranged to produce an output dependent on the noise generated by said brush means brushing against a said document, and authentication determining means connected to said at least one acoustic sensor and arranged to make a determination as to whether a document contacted by said brush means is authentic on the basis of the output of said at least one acoustic sensor.

It should be understood that many printed documents of value, such as bank notes, have non-smooth surfaces. Thus bank notes may have areas of raised print, which areas may be different for different denominations. Movement of such a document past, and in contact with, the brush means of a system in accordance with the invention causes the brush means to generate a distinctive noise brought about by the brush means brushing against the raised print.

BRIEF DESCRIPTION OF THE DRAWINGS

Two embodiments of the present invention will now be described by way of example with reference to the accompanying drawings in which.

Detailed Description

Figure 1:
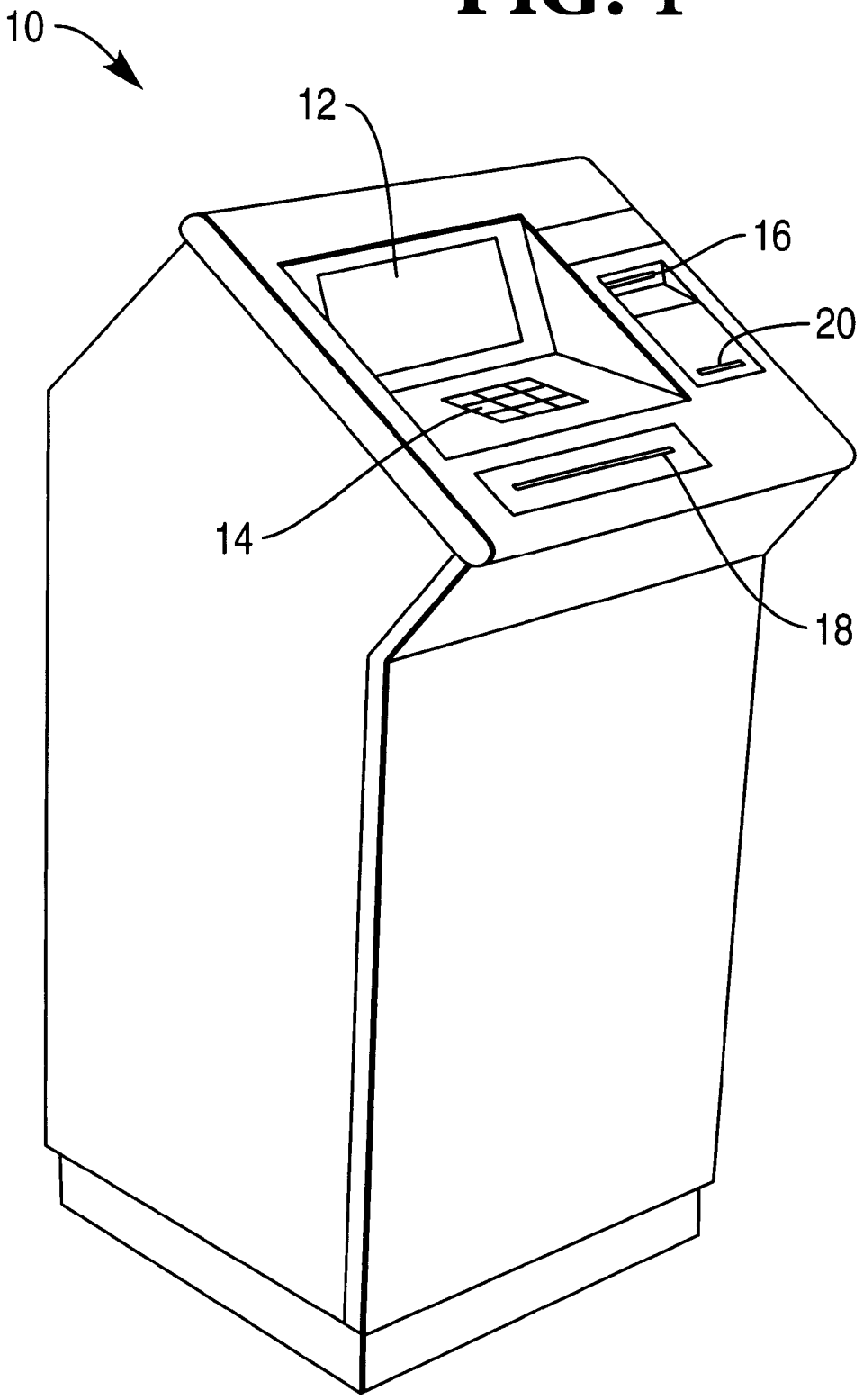
FIG. 1 is a perspective view of a currency deposit machine adapted to include a first embodiment of the invention.

Referring to FIG. 1, a currency deposit machine 10 comprises a display 12 for displaying user information, a key pad 14 for inputting data, a card reader 16 for receiving a user identity card, and a deposit slot 18 for accepting currency notes deposited into the slot 18 with their long edge parallel to the slot 18. A shutter (not shown) blocks the deposit slot 18 a set time after the deposited notes are drawn into the machine 10. If the notes are placed with their short edges parallel to the slot 18, the shutter would close on the notes before they are fully drawn into the machine 10. The notes could then be released from the shutter by the user and deposited correctly with their long edges parallel to the slot 18. The currency deposit machine 10 also contains a receipt printer 20 for printing out an acknowledgment of the deposit.

Figure 2:
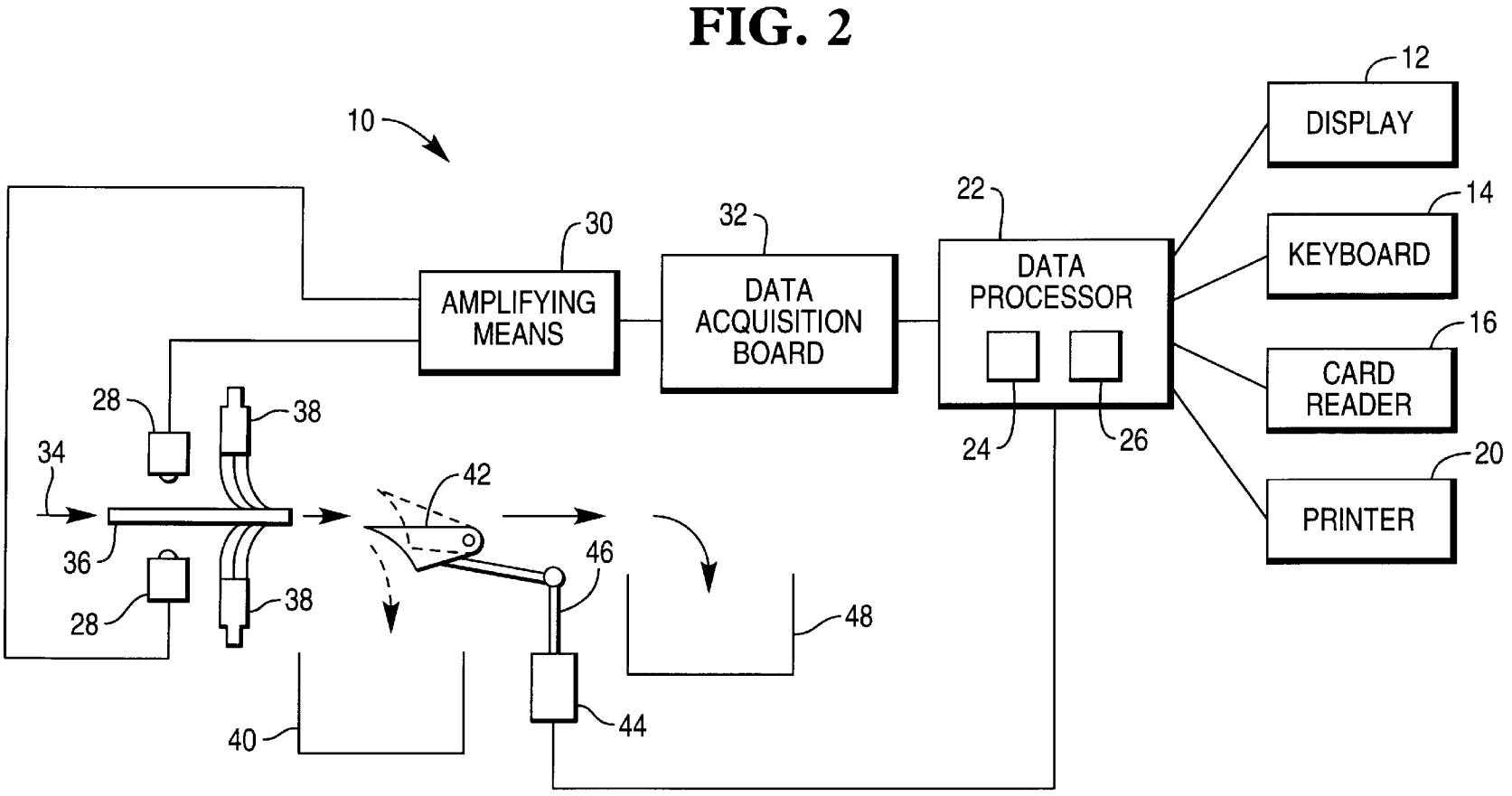
FIG. 2 is partly a schematic view and partly a block diagram representation of the currency deposit machine of FIG. 1.

Referring to FIG. 2, the currency deposit machine 10 includes a data processing means 22 to which the display 12, keyboard 14, card reader 16 and receipt printer 20 are connected. The data processing means 22 comprises memory locations 24 and 26. Upper and lower sets of microphones 28 are connected to the data processing means 22 via amplifying means 30 and via a data acquisition board 32 arranged to convert the amplified analog outputs of the microphones 28 into digital form for application to the data processing means 22. The microphones 28 are omnidirectional electret condenser microphones.

When notes are deposited in the currency deposit machine 10, they are separated out by conventional means (not shown) and individually passed along a feed path (shown by arrow 34) by transport means (not shown). The feed path 34 takes each note 36 between the upper and lower sets of microphones 28. The microphones 28 are placed in close proximity to a pair of hog hair brushes 38 spaced so that the bristles of the brushes 38 are in contact with the two faces of a note 36 as it passes between the brushes 38. If, by means of the microphones 28 and the brushes 38, the data processing means 22 detects that a note 36 is not authentic (in a manner to be described in more detail later), then the data processing means 22 causes this note 36 to be diverted into a reject bin 40. This is done by the data processing means 22 activating a divert gate 42 into the position shown in chain outline by means of a solenoid 44 and connecting means 46. A message stating that a note has failed an authenticity test may be displayed by the data processing means 22 on the display 12. If the note 36 is detected to be genuine then the divert gate 42 remains in its home position shown in solid outline and the note 36 is fed into a collection means 48.

Print produced by an intaglio printing process is a security feature found on many bank notes and is located at different positions on different denominations of bank notes. Such print is raised above the general surface level of a note giving the bank note a distinctive feel.

Figure 3:
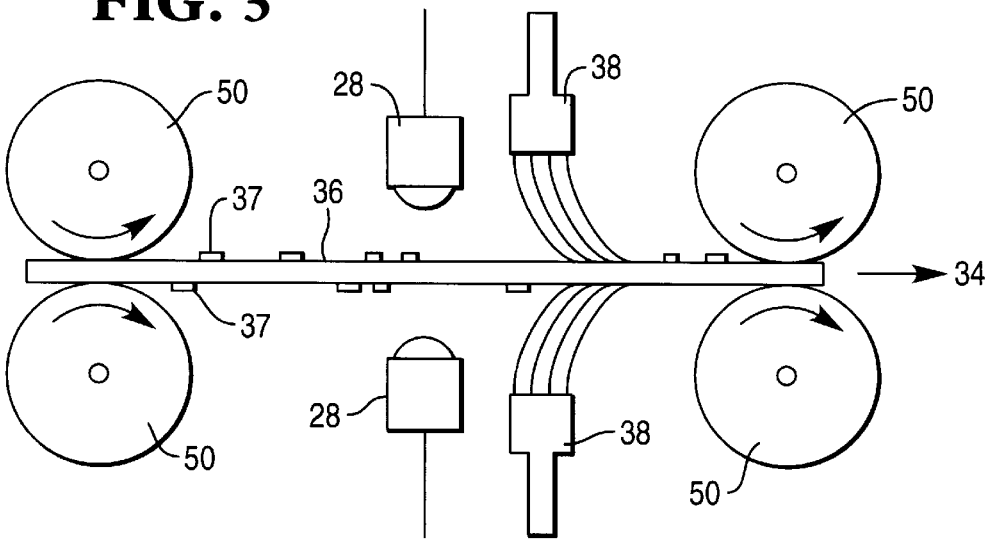
FIG. 3 is a side elevational view of a brush and sensor mechanism of an authentication system in accordance with the invention.
Figure 4:
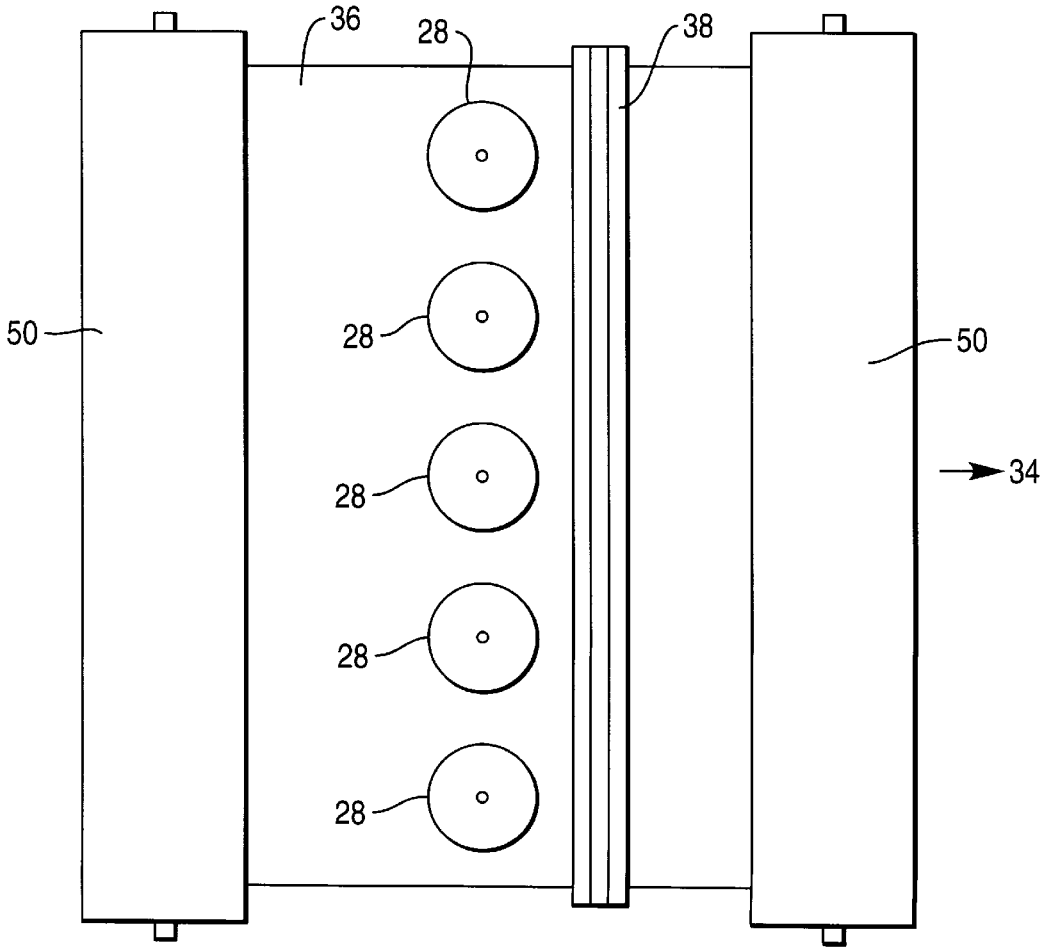
FIG. 4 is a plan view of the mechanism of FIG. 3.

Referring to FIGS. 3 and 4, a note 36 is shown moving along a feed path (shown by arrow 34) by transport means 50 between the upper and lower sets of microphones 28 that are evenly spaced across the width of the feed path 34 of the note 36. The feed path 32 also passes between a pair of coarse hog-hair brushes 38 that extend across the width of the feed path 34, i.e. across the whole of the long dimension of the note 36. If the note 36 is a genuine note having raised print 37, then the print causes the bristles of the brushes 38 to be disturbed. Such disturbances of the bristles generate a distinctive noise in the audio range which is picked up by the microphones 28.

It should be understood that if the note 36 was forged then it would have a comparatively smooth surface causing less disturbance to the bristles of the brushes 38 so that less noise would be picked up by the microphones 28.

Figure 5A:
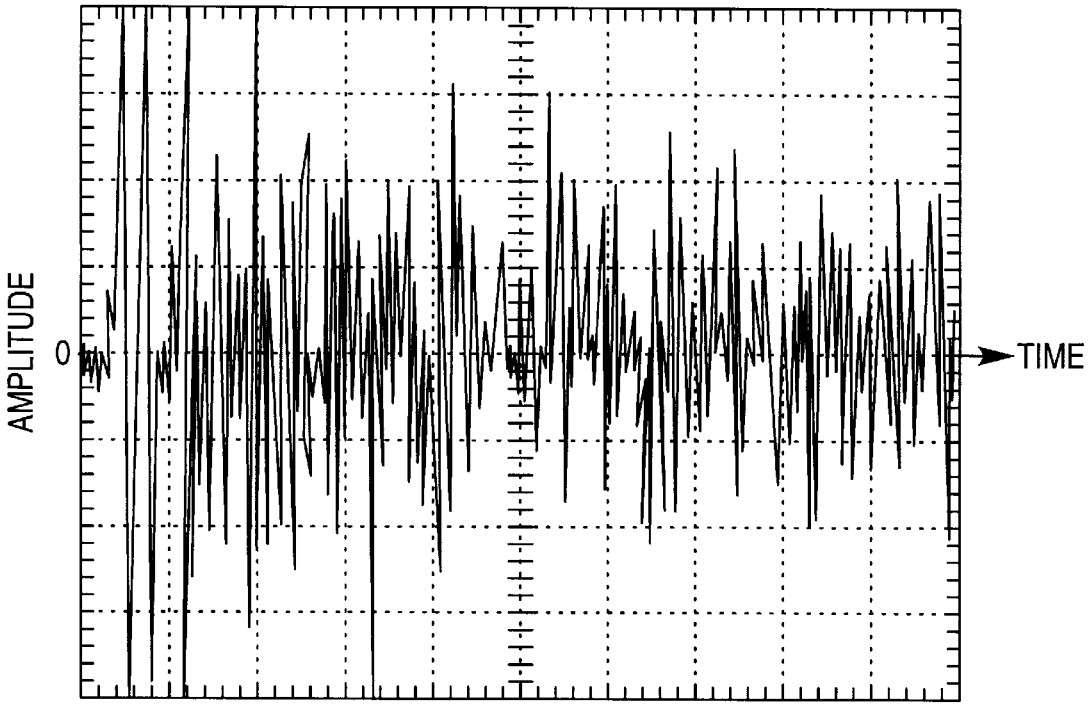
FIG. 5A is a plot of the output from an acoustic sensor for a genuine note.
Figure 5B:
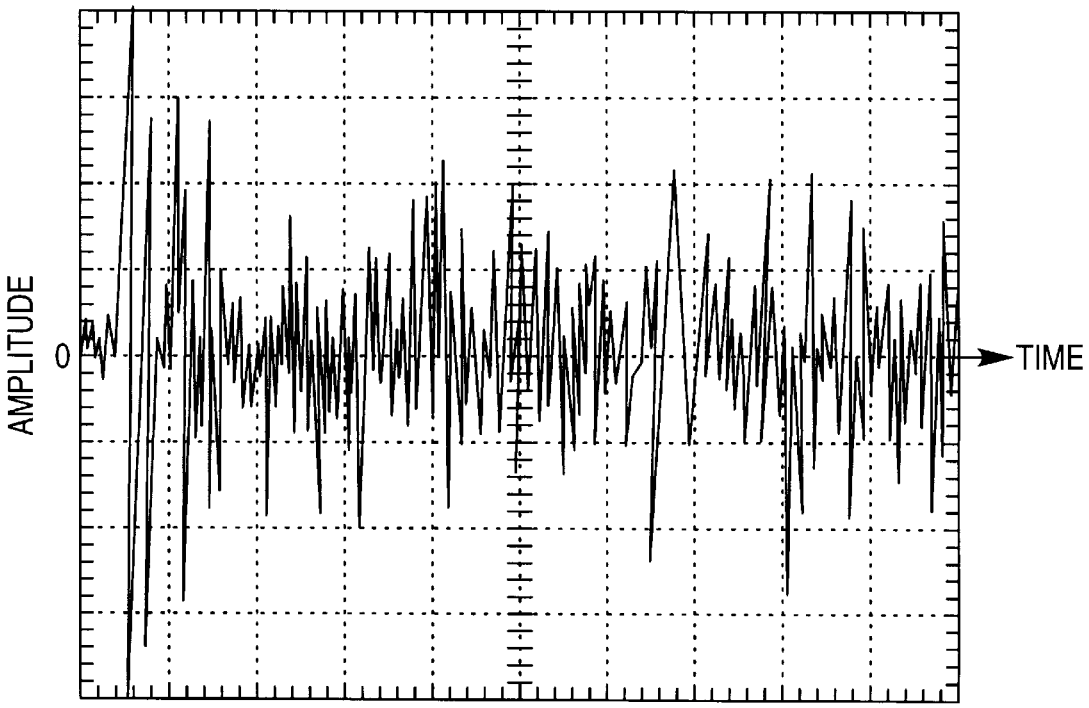
FIG. 5B is a plot of the output from an acoustic sensor for a forged note.

Referring now to FIGS. 5A and 5B there are shown therein the plots for the output from a microphone for a genuine note and a forged note respectively, where each note has passed a single coarse hog hair brush that has had an omni-directional electret condenser microphone placed in close proximity to the brush. The voltage amplitude of the output is shown against the time it takes for the note to be transported past the microphone and brush. FIG. 5A shows the results for a Bank of England £20 note being passed, and FIG. 5B shows the results for a forged £20 note being passed in the same orientation and direction. It can be seen that the lack of intaglio printing on the forged note causes a much smaller voltage amplitude, and a less distinctive plot.

If the output of the microphone is sampled at a fixed rate for the duration of the note being transported past the brush, and a root mean square value is calculated in respect of the digital values representing the sampled output, then a value representative of the noise output produced by brushing against the note can be found. Different types of currency notes have their intaglio printing on different places and may be on both sides of the note. Hence, as shown by FIGS. 2, 3 and 4, by having a pair of brushes 38 that cover the length and both faces of any bank note, and by having a series of pairs of spaced microphones 28 as shown, notes can be validated regardless of whether the notes are placed in the machine face up or upside down. In a slight variation of the system, the leading edge can be a short edge of a banknote. Each note is passed by the transport means 50 between the brushes 38 and the microphones 28. The microphones 28 are sampled at a fixed rate by the data aquisition board 32. The data processing means 22 calculates a root mean square value in respect of the digital values representing the sampled output of each microphone 28. These values (one for each microphone) are then summed to form a value representative of the noise output for the note which is stored in memory location 24 of the data processing means 22. By summing the values this helps overcome the effect of dirt on bank notes. The value stored in memory location 24 is then compared with a look-up table stored in memory location 26, this look-up table comprising a plurality of ranges of values respectively corresponding to the different denominations of notes which the system is adapted to authenticate. If the value stored in memory location 24 is not within any of the ranges of values stored, then the note is deemed to be a forgery.

This system of detecting forged notes could also be used as a way of automatically determining and possibly sorting different currency types or denominations.

Figure 6:
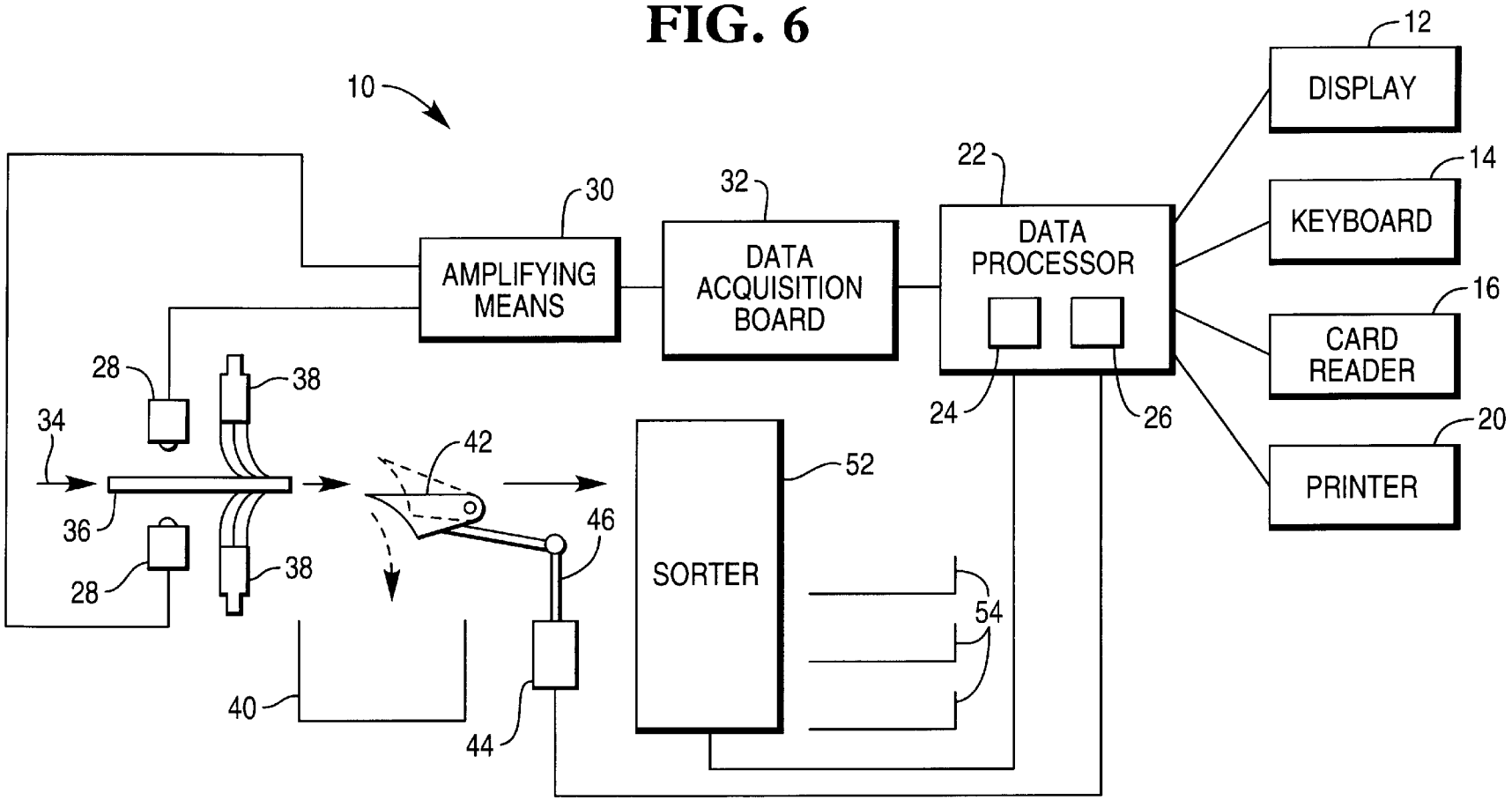
FIG. 6 is partly a schematic view and partly a block diagram representation of the currency deposit machine of FIG. 1 adapted to include a sorting means.

Referring to FIG. 6, there is shown a system similar to that shown in FIG. 2, adapted to include a sorter 52. After the data processing means 22 identifies each note that passes through the brushes 38 by correctly matching the value stored in memory location 24 with one of the ranges of values stored in memory location 26, it then activates the sorter 52 to sort the note into one of a plurality of stores 54 where each store holds notes of one particular denomination.

Figure 7:
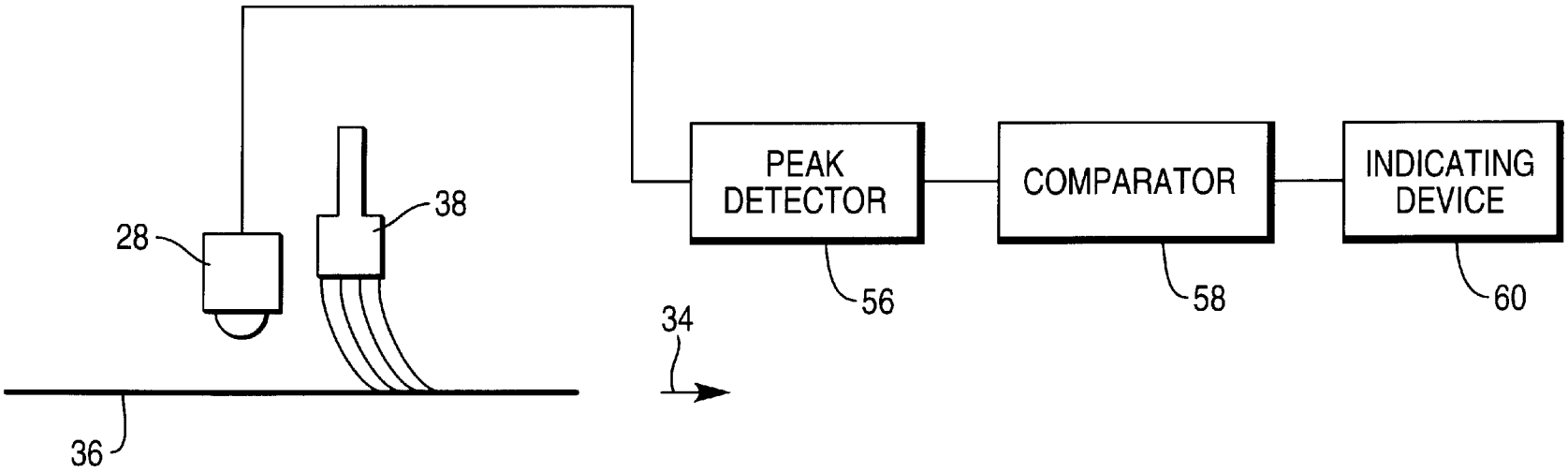
FIG. 7 is partly a schematic view and partly a block diagram representation of a second embodiment of the invention showing a simplified authentication system.

Referring to FIG. 7, a simplified version of the system for detecting a particular type of note which does not require a data processing means is shown. The system comprises a microphone 28 in close proximity to a coarse hog-hair brush 38. The output of the microphone 28 is applied to a peak detector 56 and the peak value is compared with a threshold voltage held in a comparator 58 representative of a particular note denomination. If the peak voltage is greater than the threshold voltage then the note passing along a feed path (shown by arrow 34) by transport means (not shown) is determined to be genuine and some indicating device 60 such as a light bulb could be used to indicate this.

Although humans can feel the difference between genuine and forged notes, this invention can be used to detect forged notes in any automated currency handling system. It can also be used as a device to aid sales staff in detecting forged notes.

An alternative to feeding in bank notes by hand is for them to be deposited in currency cassettes which are automatically unloaded by conventional means before the notes are individually fed through the detection system.

What is claimed is:

1. A system for authenticating a printed document having a surface, the system comprising:

transport means for moving the document along a feed path;

brush means for brushing against the surface of the document to produce noise;

acoustic sensing means for (i) sensing the noise, and (ii) producing an output indicative of the sensed noise; and authenticating means for determining authenticity of the document based upon the output of the acoustic sensing means.

2. A system according to claim 1, wherein the authenticating means includes (i) means for generating analog samples corresponding to the output of the acoustic sensing means and converting the analog samples to digital values, and (ii) data processing means for processing the digital values to determine the authenticity of the document.

3. A system according to claim 2, wherein the data processing means includes (i) storage means for storing a range of values associated with authentic documents, and (ii) processor means for determining an intermediate value representative of the document based upon the digital values and comparing the intermediate value with the range of values stored in the storage means to determine the authenticity of the document.

4. A system according to claim 3, wherein the processor means includes (i) means for determining root mean square (RMS) values of the digital values associated with the acoustic sensing means, and (ii) means for summing the RMS values to determine the intermediate value representative of the document.

5. A system according to claim 3, wherein (i) the storage means stores a range of values associated with authentic documents of different types, and (ii) the processor means compares the intermediate value with the range of values stored in the storage means to determine the authenticity and type of the document.

6. A system according to claim 5, further comprising (i) a number of storage bins for storing a document according to the type of the document, and (ii) sorting means for sorting the document into one of the storage bins when the processor means determines the authenticity and the type of the document.

7. A system according to claim 6, further comprising (i) a reject container for collecting a document determined to be a forged document, and (ii) divert means for diverting the forged document into the reject container.

8. A system according to claim 1, wherein the acoustic sensing means includes a number of acoustic sensors, each sensor sensing noise characteristic of the document and producing at least a portion of the output of the acoustic sensing means.

9. A bank note handling mechanism for authenticating a bank note having a surface, the mechanism comprising:

a transporter for moving the bank note along a feed path;

a brush for brushing against the surface of the bank note to produce noise;

an acoustic sensor for (i) sensing the noise, and (ii) producing an output signal indicative of the sensed noise; and an authenticating device for determining authenticity of the bank note based upon the output signal of the acoustic sensor.

10. A bank note handling mechanism according to claim 9, wherein the authenticating device includes (i) a data acquisition unit for generating analog samples corresponding to the output signal of the acoustic sensor and converting the analog samples to digital values, and (ii) a data processor unit for processing the digital values to determine the authenticity of the bank note.

11. A bank note handling mechanism according to claim 10, wherein the data processor unit includes (i) a memory for storing a range of values associated with authentic bank notes, and (ii) a processor for determining an intermediate value representative of the bank note based upon the digital values and comparing the intermediate value with the range of values stored in the memory to determine the authenticity of the bank note.

12. A bank note handling mechanism according to claim 11, wherein the processor (i) determines root mean square (RMS) values of the digital values associated with the acoustic sensor, and (ii) sums the RMS values to determine the intermediate value representative of the bank note.

13. A bank note handling mechanism according to claim 11, wherein (i) the memory stores a range of values associated with authentic bank notes of different types, and (ii) the processor compares the intermediate value with the range of values stored in the memory to determine the authenticity and type of the bank note.

14. A bank note handling mechanism according to claim 13, further comprising (i) a number of storage bins for storing a bank note according to the type of the bank note, and (ii) a sorter for sorting the bank note into one of the storage bins when the processor determines the authenticity and the type of the bank note.

15. A bank note handling mechanism according to claim 14, further comprising (i) a reject container for collecting a bank note determined to be a forged bank note, and (ii) a diverter for diverting the forged bank note into the reject container.

16. A method of authenticating a bank note moving along a feed path, the method comprising the steps of:

(a) producing noise characteristic of the bank note as the bank note moves along the feed path; and (b) determining authenticity of the bank note based upon noise produced in step (a).

17. A method according to claim 16, wherein step (a) includes the step of:

(a-1) brushing a surface of the banknote to produce noise characteristic of the bank note.

18. A method according to claim 17, wherein step (b) includes the steps of:

(b-1) determining an intermediate value representative of the bank note based upon noise produced in step (a); and (b-2) comparing the intermediate value with a range of values associated with authentic bank notes to determine the authenticity of the bank note.

19. A method according to claim 18, wherein step (b-2) includes the steps of:

(b-2-1) determining root mean square (RMS) values associated with noise produced in step (a); and (b-2-2) summing the RMS values of step (b-2-1) to determine the intermediate value representative of the bank note.

20. A method according to claim 16, further comprising the steps of:

(c) providing a reject container for collecting a bank note determined to be a forged bank note; and (d) diverting the forged bank note into the reject container.

21. Apparatus for verifying a bank note, comprising:

a) one or more brushes having bristles;

b) means for brushing the bristles across the bank note, to thereby produce acoustic noise which radiates through space surrounding the bristles;

c) microphone means for i) receiving noise which travelled through the space, and ii) producing a time-varying signal in response; and d) means for issuing an authentication signal if an average of the time-varying signal exceeds a threshold.

22. System according to claim 1, wherein i) the brush means and the acoustic sensing means are separated by a space; and ii) the noise reaching the acoustic sensing means travels through the space.

23. Mechanism according to claim 9, wherein i) the brush and the acoustic sensor are separated by a space; and ii) the noise reaching the acoustic sensor means travels through the space.

* * * * *